United States Patent [19]

Masuda et al.

[11] 4,263,984

[45] Apr. 28, 1981

[54] TRUCK SERVING AS A WORKBENCH

[76] Inventors: Akira Masuda; Shigemori Hayashida, both of 1-10-1, Kakigaracho, Nihonbashi, Chuo-ku, Tokyo, Japan

[21] Appl. No.: 27,149

[22] Filed: Apr. 4, 1979

[51] Int. Cl.[3] ..... E04G 1/20

[52] U.S. Cl. ..... 182/113; 182/119; 182/179; 182/129

[58] Field of Search ..... 182/119, 118, 113, 179, 182/178, 129

[56] References Cited

U.S. PATENT DOCUMENTS

| | | | |
|---|---|---|---|
| 2,159,902 | 5/1939 | Lewis | 182/113 |
| 2,203,113 | 6/1940 | Vecker | 182/178 |
| 2,882,100 | 4/1959 | Bank | 182/178 |
| 3,396,817 | 8/1968 | Perry | 182/119 |
| 3,425,509 | 2/1969 | Gilbert | 182/113 |
| 3,498,412 | 3/1970 | Best | 182/113 |
| 3,675,736 | 7/1972 | Roggie | 182/119 |
| 4,088,202 | 5/1978 | Costello | 182/119 |

*Primary Examiner*—Reinaldo P. Machado
*Attorney, Agent, or Firm*—McGlew and Tuttle

[57] ABSTRACT

A scaffold device is disclosed which includes a workbench guidably movable with respect to support posts. A peripheral skirt, supporting the workbench, has socket members at each corner which slidably engage the support posts. The socket member may be locked to the support posts.

3 Claims, 11 Drawing Figures

TRUCK SERVING AS A WORKBENCH

FIELD AND BACKGROUND OF THE INVENTION

The present invention relates to a truck serving as a workbench which can be moved freely, and in particular in which a stage as the workbench and handrails can be fine-adjusted at any height according to working places and a suitable space is formed under the stage so as to be able to travel freely without obstruction by furnishings such as a desk.

Generally, scaffolds are established in working places where there are carried out works such as the construction, repair and dismounting of ships as well as public works such as the construction and repair of roads, tunnel, etc., and workers walk and operate machines on the scaffolds. However, it is very troublesome to assemble or disassemble such a scaffold, for example in the tower form, and the operating efficiency is low, and moreover it is disadvantageously costly in many case. When a work is carried out in the interior of a building or the hold of a ship, only a small space can be made free of use. In such a small space it is not only very difficult to assemble and disassemble a scaffold but also it becomes necessary to assemble and disassemble the scaffold again when the work is finished at a site and is carried out at another site. If scaffolds are established at all the work sites for this reason, too much work force and too many parts will be required and the working efficiency will be detrimentally affected.

Therefore, a tower-like scaffold which can be moved to work sites, for example shown in FIG. 1, has been developed. Such a scaffold comprises four support posts 1, 2, 3 and 4, casters 5 rotatably fitted to the lower ends of the support posts, X-shaped presses 6 connected between the support posts 1 and 3, and the support posts 2 and 4, horizontal support rods 7 stretched out between the support posts 1 and 2, and support posts 3 and 4, a horizontal stage 8 as a workbench mounted on the uppermost support rods 7, and handrails 9 and 10 provided at the upper portions of the support posts 1, 2, 3 and 4 along the stage 8. However, there are disadvantages in such scaffold in that the height of the stage 8 and the handrails cannot be freely changed according to the height of work sites because their set-up positions are determined, and that there are instances where the scaffold cannot be moved freely in a small space because of the X-shaped presses 6 connected between the support posts 1 and 3, and 2 and 4 which may strike against obstructive machines and other furnitures. Though there is no problem in case of establishing such scaffold on a flat place, a further disadvantage of the scaffold is that in a place where the surface is stepped such as stairs, the scaffold falls down and cannot stand up.

On the other hand, various trucks for transporting baggages have been proposed heretofore. However, it is difficult to move such a truck freely in a small space such as the interior of a house in which there is furniture such as desks, tables, chairs, steel cases, etc. because the truck body may strike against the furniture.

SUMMARY OF THE INVENTION

An object of the present invention is to provide a scaffold device combining a workbench for scaffold with a truck for transporting baggages in which the height of the stage can be changed freely according to working places.

In other object of the present invention is to provide a scaffold device in which handrails are kept at a constant height according to the height of the stage.

A further object of the present invention is to provide a truck serving also as a workbench in which relatively large space can be formed under the stage so as to be able to travel the body without obstruction by furniture.

A still further object of the present invention is to provide a truck serving also as a workbench which can be stood up so as to become the body horizontal even on the surface of the earth and floor stepped as stairs.

BRIEF DESCRIPTION OF THE DRAWINGS

Now, embodiments of the present invention will be described hereinafter referring to the accompanying drawings, wherein.

DETAILED DESCRIPTION

Figure 2:
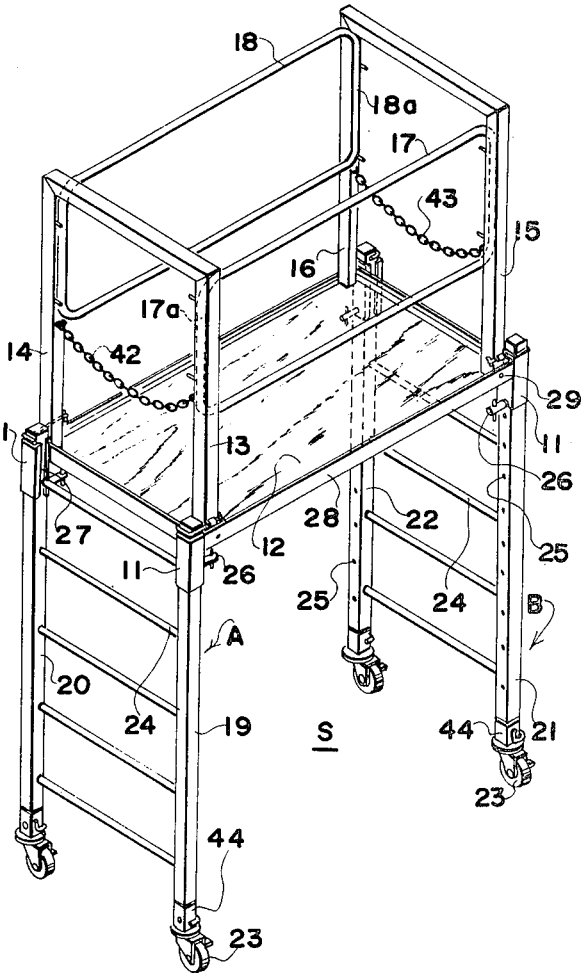
FIG. 2 is a perspective view of a truck serving also as a workbench according to an embodiment of the present invention.
Figure 3:
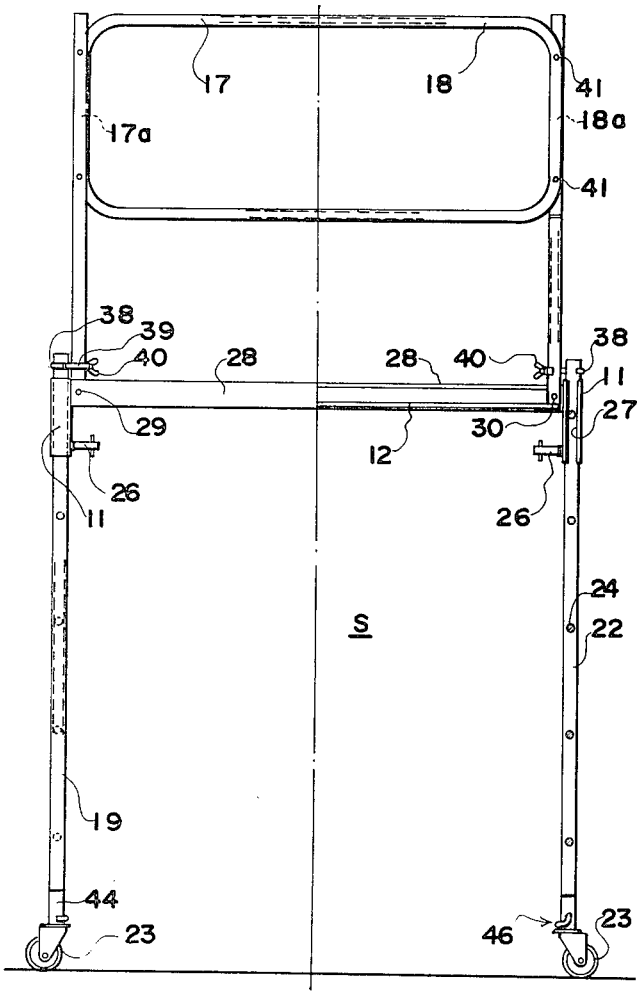
FIG. 3 is an elevational view of FIG. 2, with portions in vertical section.
Figure 4:
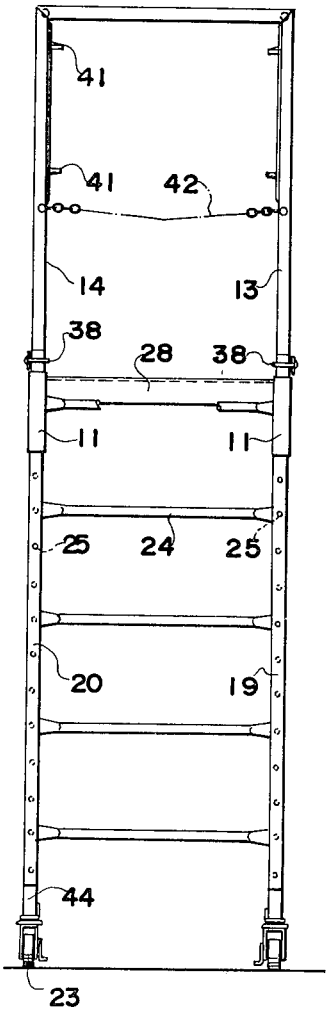
FIG. 4 is a rough side view of FIG. 2.
Figure 5:
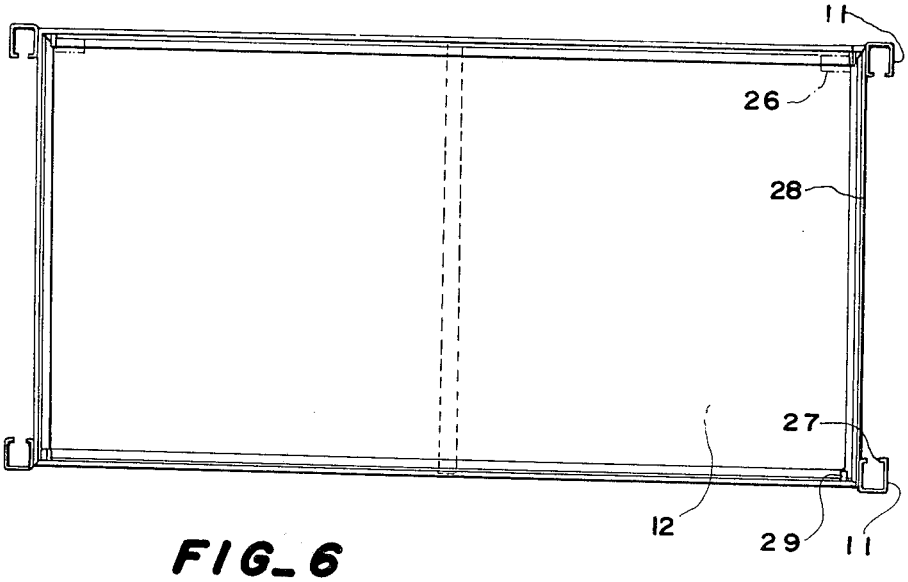
FIG. 5 is a plan view of a stage.

As shown in FIG. 2, a pair of a left and a right upright ladder support frames A and B in parallel with each other, a substantially rectangular stage 12 is coupled to the both support frames A and B by means of a pair of vertically elongated sockets 11 having a longutudinal opening so that the stage 12 is vertically slidable over main support posts, four auxiliary support posts 13, 14, 15 and 16 are connected to the four corners of the stage 12 and stand up vertically, and handrails 17 and 18 are removably fitted between the auxiliary support posts 13 and 15, and 14 and 16, respectively.

The left support frame A comprises two main upright support posts 19 and 20 parallel with each other, and the right support frame B comprises also two main upright support posts 21 and 22 parallel with each other, and each of these main support posts 19, 20, 21 and 22 is provided with a caster 23 at the lower end.

One or more supporting beams 24 are laterally extended between the left main support posts 19 and 20, and the right main support posts 21 and 22 at a distant so that the main support posts 19 and 20, and 21 and 22 are kept parallel, respectively and strengthened.

Figure 1:
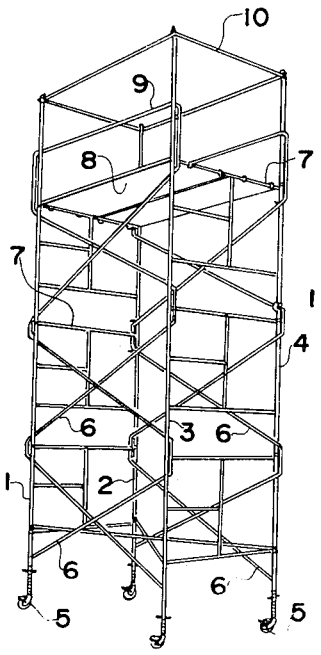
FIG. 1 is a perspective view of a conventional scaffold device.

The main support posts 19, 20, 21 and 22 and the auxiliary support posts 13, 14, 15 and 16 are preferable in a square form in section as shown in FIG. 1, and it is also possible to use other profiles such as columns.

Each of the main support posts 19, 20, 21 and 22 is drilled with a plurality of pin apertures 25 at a same distant in one side, and is inserted in the socket 11 which is integrally fixed with a stopper 26 in the direction facing the pin apertures 25, so that when the sockets 11 are moved vertically at a desired position and the pins of the stoppers 26 are set in pin apertures 25, the sockets 11 and the stage 12 are kept at a level of the pin apertures 25. Thus each of the sockets 11 is, for example, in the form of square bar according to the main support posts 19, 20, 21 and 22 and is provided with a vertical cutout 27 in one side facing the support beams 24 so as to be able to pass the support beams 24 through the inside of the cutout 27 when the socket 11 is vertically slided.

Figure 6:
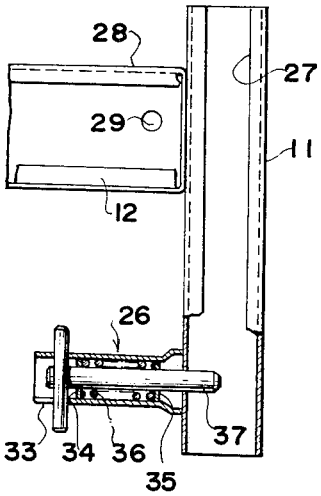
FIG. 6 is an elevational view of a socket and a stopper, with portions broken away.
Figure 7:
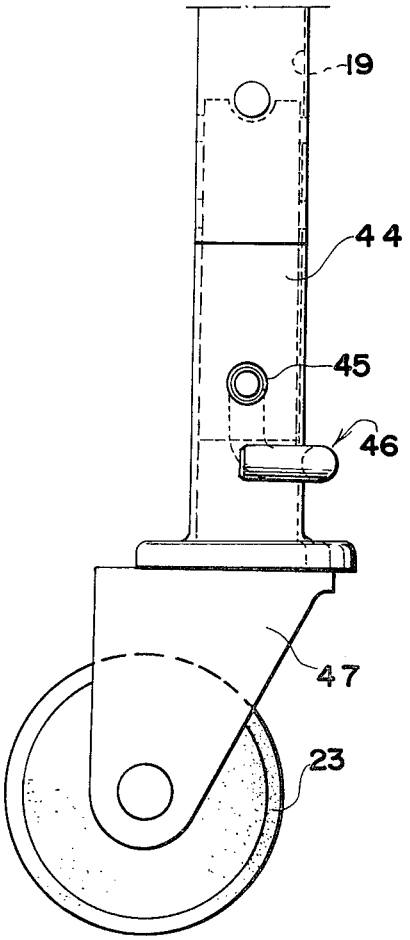
FIG. 7 is an elevational view of a caster.

The stage 12 serving as a horizontal scaffold board is fixedly mounted on the sockets 11 and is fixedly provided with vertical skirts 28 having a suitable width along its outer periphery. In this case, as shown in FIG. 6 the outer end portion of each of the skirts 28 is fixedly attached to the outside edge of the socket 11, for example, by means of the welding, and the lower end of the skirt 28 is inwardly folded and the stage 11 is placed and fixed on the folded portion of the skirt 28. Also, each of the skirts 28 is provided with an inwardly projected pin 29 so that the stage 12 is removably mounted by inserting the pin 29 into a pin aperture 30 drilled in each of the auxiliary support posts 13, 14, 15 and 16 at the lower end outside portion.

An end of a guide pipe 31 of each of the stopper 26 is fixedly attached to the outside of the socket, for example by welding, and a T- or L-shaped pin 32 is slidably inserted in the guide pipe 31. Two cutouts 33 are formed in the guide pipe at upper and lower end portions, a washer 34 is fixedly provided on the inner wall of the guide pipe 31 at the rear portion, and a flange 35 is fixedly provided on the pin 32 at an approximately middle portion so as to freely slide the pin 32 through the middle of the washer 34, and further a spring 36 is interposed between the washer 34 and the flange 35.

When the handle portion 32*a* of the pin 32 is inserted into the cutouts 33, the pin 32 may be pushed in by means of the tension of the spring 36 to extend its tip from an aperture 37 of the socket 11 and then inserted into one of the pin apertures 25 of each of the main support posts 19, 20, 21 and 22. On the other hand, when the handle portion 32*a* is pulled away from the cutouts 33 and is rotated at an angle of about 180° to put up the handle portion 32*a* against the rear end of the guide pipe 31, the pin 32 is kept drawn out of the pin aperture 25 and the aperture 37 of the socket 11.

A hook bolt 38 is slidably fitted to the lower portion of each of the auxiliary support posts 13, 14, 15 and 16 by means of a guide pipe 39 in such manner that a threaded portion of the hook bolt 38 is engaged and the hook bolt is compressed by rotating a nut 40 in the state where a curved hook portion 38*a* of the hook bolt 38 and a hook portion 39*a* formed in the guide pipe 39 are hooked on the outer periphery of each of the main support posts 19, 20, 21 and 22 whereby the hook bolt 38 is firmly coupled with the lower portion of each of the auxiliary support posts 13, 14, 15 and 16 against the side of each of the auxiliary support posts 13, 14, 15 and 16, and at the same time each of the auxiliary support posts is kept in its desired height relative to each of the main support posts as well as is prevented from shock and vibration.

The auxiliary support posts 13, 14, 15 and 16 are provided with upper and lower lock pins 41, respectively, by means of which the both sides of the handrails 17 and 18 may be removably fitted to the auxiliary support posts.

The handrails 17 and 18 are made of square pipes having both flattened side portions 17*a* and 18*a* in which apertures are formed at positions corresponding to the locking members 41, so that the handrails 17 and 18 may be coupled to the side of the auxiliary support posts by inserting the locking members 41 into the apertures of the handrails to lock them. The handrails 17 and 18 should not be restricted to those shown in the drawings and it should be understood that any other handrails may also be used if they serve for preventing workers, machinery, etc. on the stage 12 from falling, for example a pair of pipes may also be fixed to the locking members. Moreover, chains 42 and 43 are stretched out between the auxiliary support posts 13 and 14, and 15 and 16, respectively, by means of clasps etc. the chains also serve as handrails.

The lower end of each of the main support posts 19, 20, 21 and 22 is inserted in a caster socket 44, each of the main support posts 19, 20, 21 and 22 and the caster socket 44 are drilled with apertures 45, respectively, registered each other so as to couple the main support posts 19, 20, 21 and 22 with the caster sockets 44 by inserting lock pins 46 into the apertures 45. Each of the caster sockets 44 is rotatably connected with a bracket 47 by which the caster 23 is rotatably beared.

Figure 8:
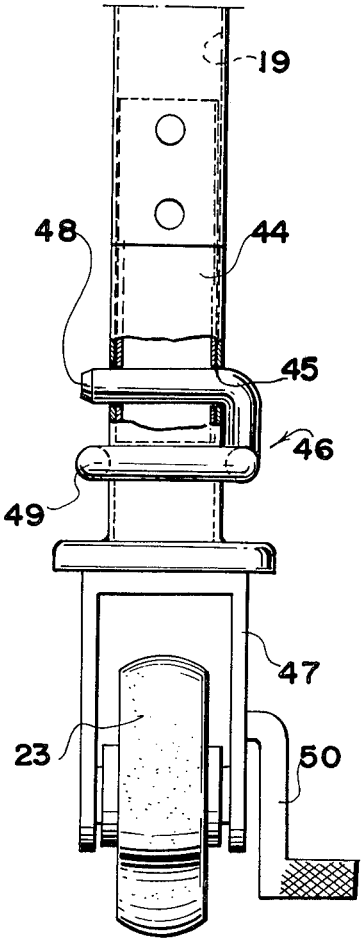
FIG. 8 is a side view of the caster.

Though the lock pin 46 may be a straight rod pin, it is advantageous that, as shown in FIG. 8, two L-shaped pins 48 and 49 are so connected to each other that one is vertical and the other is horizontal whereby the locking is ensured by preventing the lock pin from coming out of joint.

Each of the casters 23 is provided with a brake 50 so as to be able to brake.

Though one post is provided uprightly for each of the main support posts 19, 20, 21 and 22 in the embodiment shown in the drawings, it is also possible to uprightly connect additional posts to the main support posts in series by means of further sockets 11 and further stoppers 26, or other join members in order to make the scaffold much higher.

Now the operation and the effect of the present invention will be described hereinafter.

According to the truck serving also as a workbench of the present invention, it is possible to establish the scaffold corresponding to any work site because it is freely movable by means of the casters 23 and there is no need to assemble and disassemble the scaffold at every time the work site is changed. The device of the present invention can also be used as a truck because it can be moved to other work site with machines, work tools, etc. on the stage all together.

Because the stage 12 and the auxiliary support posts 13, 14, 15 and 16 are vertically slidable to be locked corresponding to the pitch of the apertures 25 of the main support posts 19, 20, 21 and 22, it is very easy to finely adjust the level of the stage 12. In addition, the handrails 17 and 18 may also be vertically moved together with the auxiliary support posts 13, 14, 15 and 16, so that the handrails 17 and 18 may be kept constant in their height relative to that of the stage 12, ensuring the safety.

Figure 9:
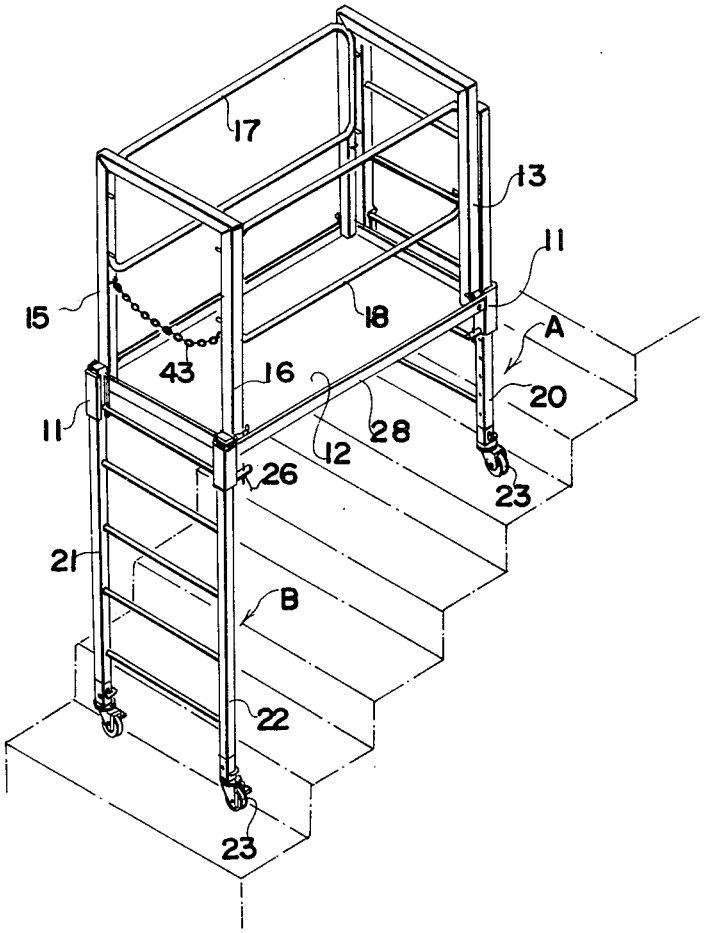
FIG. 9 is a perspective view of the truck which is placed on the stairs.
Figure 10:
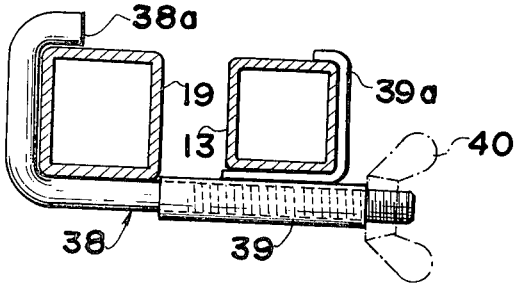
FIG. 10 is a sectional view of a hook bolt.

When the stage 12 is locked at the upper portion of the auxiliary support posts 13, 14, 15 and 16, a large space S is formed under the state 12. Therefore, the scaffold device may be moved very easily because obstacles on the travel way of the scaffold device may pass through the space S without striking the main support posts 19, 20, 21 and 22 against the obstacles. Further, when the scaffold is established on stairs or other stepped places as shown in FIG. 9, for example, the left support frame A and the right support frame B are made stand on an upper and a lower step of the stairs, respectively, and then the left side of the stage 12 is made held at lower portions of the support posts 19 and 20 while the right side of the stage 12 is made held at upper portions of the support posts 21 and 22 so as to be kept the stage 12 horizontal to the ground.

The device of the present invention can be used as a scaffold in the manner described above, while it is also possible to use it as a truck for transporting baggages in the following manner: the stage 12 with or without the auxiliary support posts 13, 14, 15 and 16 and the handrails 17 and 18 is locked to the support posts 19, 20, 21 and 22 at a desired height so as to form a relatively a large space S under the stage 12. Then the baggages are laid on the stage 12, and the support posts 19, 20, 21 and 22 are pushed to cause the casters 23 to freely move the truck together with the baggages to a desired place without obstructed by furniture in the interior of the house such as desks because of the space S.

Further, the truck serving also as a workbench of the present invention is simple in the structure, consists of a relatively small number of parts, and therefore can be assembled easily as well as it can also be disassembled and pack the device very easily thus it is very advantageous in working efficiency and economy. The support posts 19, 20, 21 and 22, and 13, 14, 15 and 16, the hook bolts 38, and the handrails 17 and 18 can be disassembled to respective members which can be compactly packed so as not to occupy much room for storage. It is also possible to transport the compact package put in the back case in a car, for example and to easily assemble into the scaffold at the work site again. In the meantime, though the casters 23 are directly connected to the main support posts 19, 20, 21 and 22 at the lower ends thereof by means of the socket, it is also possible to connect them as follows in order to improve the stability: the casters 23 are fixed at both ends of elongated horizontal support rods, two upright sockets are fitted at two approximately middle points of the horizontal support rods, respectively, and the lower ends of the main support posts 19, 20, 21 and 22 are inserted in the sockets.

Figure 11:
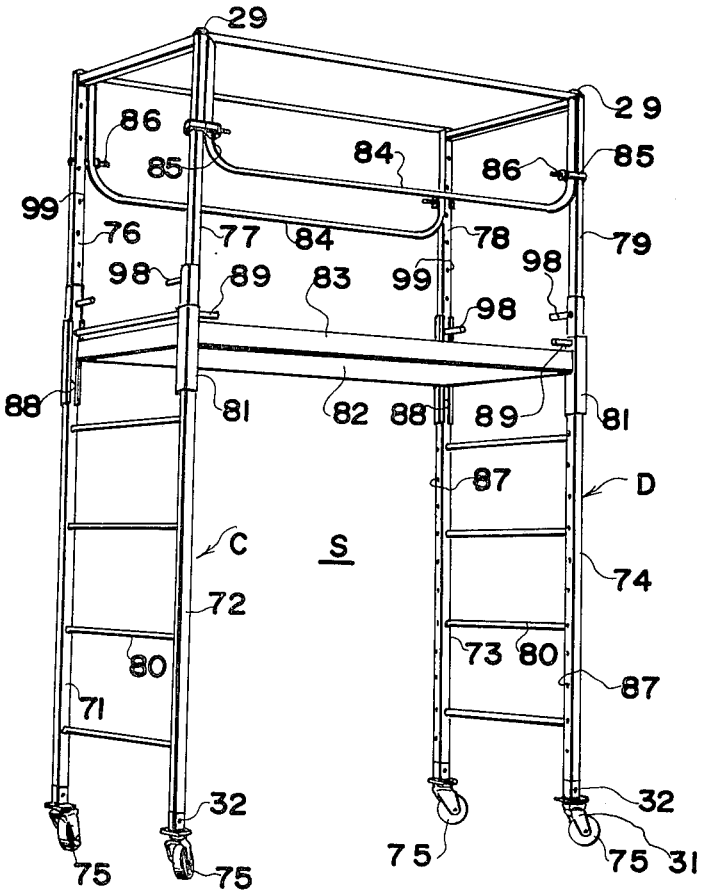
FIG. 11 is a perspective view of a truck serving also as a workbench according to an other embodiment of the present invention.

There is shown in FIG. 11 an other truck serving also as a workbench according to a further embodiment of the present invention. This scaffold device comprises at least a pair of a left and a right upright ladder support frames C and D, said left support frame C consisting of two left parallel main support posts 71 and 72 and said right support frame D also consisting of two right parallel main support posts 73 and 74, and said main support posts 71, 72, 73 and 74 being provided with casters 75 at the lower end thereof and being connected with slidable upright left and right auxiliary support posts 76 and 77, and 78 and 79, respectively. A plurality of beams 80 are stretched out horizontally between the parallel left and right main support posts 71 and 72, and 73 and 74, respectively, so as to couple and keep parallel the left and right support posts 71 and 72, and 73 and 74, respectively.

The support posts 71, 72, 73 and 74 are slidably inserted in socket 81 to which a horizontal stage 81 and upright side plates 83 surrounding the periphery of the stage 81 are fixedly attached, for example by welding so that the vertical slide of the sockets 81 results in vertically sliding all together with the stage 82 and the side plates 83 by the guide of the support posts 71, 72, 73 and 74.

Two parallel front and rear ⊐-shaped handrails 84 are provided above the stage 82, and the both ends of the handrails 84 are connected to the auxiliary support posts 77 and 79, and 76 and 78, respectively, by means of hook bolts 85 and nuts 86.

The main support posts 71, 72, 73 and 74, and the auxiliary support posts 76, 77, 78 and 79 are may be made from a hollow material such as a square pipe. The main support posts 71, 72, 73 and 74 are drilled with a plurality of holes 87 at an equal pitch in the longitudinal direction so that the stage 82 is vertically slided by means of the sockets 81 and pins of stoppers 89 are inserted into any suitable holes 82 whereby the stage 12 serving both as a workbench and a stand for putting baggages thereon can be kept horizontal at the position of these holes 82. Thus, the sockets 81 are inserted by the support posts 71, 72, 73 and 74 so as to be vertically slidable against the support posts. A cutout 88 having a width through which each of beams 80 can be poassed is formed in one side of each of the sockets 81, and the stopper 89 is connected to each of the sockets 81.

The lower portions of the auxiliary support posts 76, 77, 78 and 79 with smaller diameters than the main support posts 71, 72, 73 and 74 are slidably inserted in the square openings at the upper portions of the main support posts 71, 72, 73 and 74, on the other hand the upper side portions of the support posts 71, 72, 73 and 74 are passed through by the stoppers 98 such as pins or hinge bolts. Each of the auxiliary support posts 76, 77, 78 and 79 is drilled with a plurality of holes at an equal distance. Thus, the auxiliary support posts 76, 77, 78 and 79 are vertically slided to a desired height along the main support posts 71, 72, 73 and 74, and then the stoppers 98 are inserted to the holes 99 corresponding to the desired height so that the auxiliary support posts 76, 77, 78 and 79 can be uprightly connected to the main support posts 71, 72, 73 and 74 corresponding to the positions of the holes 99 in which the stoppers 98 are inserted.

It is possible to determine the height of the auxiliary support posts 76, 77, 78 and 79, and the handrails 84 constant to the height of the workbench in such a manner that when the stage 82 is locked at the upper portion of the main support posts 71, 72, 73 and 74, the auxiliary support posts 76, 77, 78 and 79 are locked correspondingly at the upper portion of the main support posts 71, 72, 73 and 74 by means of the stoppers 84 while the auxiliary support posts 76, 77, 78 and 79 are lowered when the workbench is locked at the lower portion of the main support posts 71, 72, 73 and 74.

According to the truck serving also as a workbench of the present invention, it is possible to establish the scaffold corresponding to any work site because it is freely movable by means of the casters 75 and there is no need to assemble and disassemble the scaffold at every time the work site is changed. The scaffold can also be used as a truck because it can be moved to other work site with machines, work tools, etc. on the stage 82 all together.

Because the stage 82 is vertically slidable corresponding to the pitch of the holes 87 of the support posts 71, 72, 73 and 74, the fine adjustment of the level of the stage 82 is very easy. In addition, the handrails 84 may also be vertically moved by means of the auxiliary support posts 76, 77, 78 and 79, so that the position of the handrails 84 may be changed freely according to the level of the stage 82 and the height of a worker, ensuring the safety.

When the stage 82 is locked at the upper portion of the main support posts 71, 72, 73 and 74, a large space S is formed under the stage 82. Therefore, the scaffold device may be moved very easily because obstacles on the travel way of the device may pass through the space S without striking the main support posts 71, 72, 73 and 74 against the obstacles.

I claim:

1. In combination with a truck serving as a workbench of the type have a vertically positionable horizontal stage with a substantially rectangular cross-section, parallel support frame members adjacent opposite sides of the stage, each support frame member having vertical main support posts adjacent each corner of the stage and lateral supporting beams connected therebetween, means supporting the stage for guided movement with respect to the support posts, the improvement wherein the means for supporting the stage comprises a skirt supporting the stage along its periphery, a vertically elongated socket member fixedly attached to an outside surface of said skirt adjacent each corner of said skirt, said socket having a longitudinal opening for slidably receiving and passing a respective vertical main support post relative thereto, said socket member having a continuous longitudinal slot formed in one side thereof adjacent the lateral supporting beams for passing the beams relative thereto, means for locking said socket member to a respective vertical main support, and further comprising a vertical auxiliary post connected to the inside surface of said skirt adjacent each corner of said skirt, and in a side by side alignment with said support posts a handrail attached to said auxiliary post, and means for locking said socket to the respective main support post of each parallel support frame member in a plurality of independent vertical positions relative to the vertical positions of the main support posts of the other parallel support frame member and further comprising means for coupling said auxiliary post to respective main support post.

2. The improved combination of claim 1 wherein said coupling means comprises a hook bolt having a curved hook portion engaging said main support post and a straight threaded portion, a guide pipe having a hook portion engaging said auxiliary post and body portion with a bore extending therethrough, said body portion being disposed about said hook bolt, and a nut threadably engaging said threaded portion in abutting relationship with said body portion.

3. The improved combination of claim 1 wherein said locking means comprises a plurality of vertically spaced apertures in said main support posts, and stoppers attached to said sockets removably fitted in said pin apertures.

* * * * *